US010845086B2

(12) United States Patent
Sawada et al.

(10) Patent No.: US 10,845,086 B2
(45) Date of Patent: Nov. 24, 2020

(54) AIR-CONDITIONING CONTROL DEVICE, AIR-CONDITIONING APPARATUS, AND AIR-CONDITIONING SYSTEM

(71) Applicant: Mitsubishi Electric Corporation, Chiyoda-ku (JP)

(72) Inventors: Masae Sawada, Chiyoda-ku (JP); Mio Motodani, Chiyoda-ku (JP); Osamu Nakajima, Chiyoda-ku (JP); Takaya Yamamoto, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 76 days.

(21) Appl. No.: 16/094,100

(22) PCT Filed: May 24, 2016

(86) PCT No.: PCT/JP2016/065314
§ 371 (c)(1),
(2) Date: Oct. 16, 2018

(87) PCT Pub. No.: WO2017/203603
PCT Pub. Date: Nov. 30, 2017

(65) Prior Publication Data

US 2020/0096225 A1 Mar. 26, 2020

(51) Int. Cl.
*F24F 13/22* (2006.01)
*F24F 110/20* (2018.01)
(Continued)

(52) U.S. Cl.
CPC ..... *F24F 13/22* (2013.01); *F24F 2013/221* (2013.01); *F24F 2110/10* (2018.01);
(Continued)

(58) Field of Classification Search
CPC .... F24F 13/22; F24F 2110/20; F24F 2110/10; F24F 2140/30; F24F 2013/221;
(Continued)

(56) References Cited

U.S. PATENT DOCUMENTS 7,690,421 B2 * 4/2010 Burns ..... B60H 1/00785 165/237
9,689,583 B2 * 6/2017 Katuri ..... F24F 11/30
(Continued)

FOREIGN PATENT DOCUMENTS

DE 20 2005 015 397 U1 3/2007
EP 2 818 803 B1 6/2014
(Continued)

OTHER PUBLICATIONS

Wikipiedia, Dew Point Temperature, 2020, description of condensation (Year: 2020).*
(Continued)

*Primary Examiner* — Len Tran
*Assistant Examiner* — Joanna H Rosario
(74) *Attorney, Agent, or Firm* — Xsensus LLP

(57) ABSTRACT

An air-conditioning control device for controlling an air-conditioning apparatus configured to perform air conditioning of a room in which a device that changes an amount of water vapor is located. The air-conditioning control device includes a condensation occurrence determiner configured to determine whether condensation occurs in the room after a certain amount of time elapses by using an amount of change in water vapor, which is predicted by collating device operation data with a device operation table, and an air-conditioning controller configured to change an operation state of the air-conditioning apparatus when the condensation occurrence determiner determines that condensation occurs.

11 Claims, 7 Drawing Sheets

(51) Int. Cl.
*F24F 110/10* (2018.01)
*F24F 140/30* (2018.01)
*F24F 120/10* (2018.01)

(52) U.S. Cl.
CPC ..... *F24F 2110/20* (2018.01); *F24F 2120/10* (2018.01); *F24F 2140/30* (2018.01)

(58) Field of Classification Search
CPC ..... F24F 2003/144; F24F 2120/00; F24F 2120/10; F24F 2120/12; F24F 2120/14; F24F 2700/02; F24F 2700/2104
USPC ..... 165/232
See application file for complete search history.

(56) References Cited

U.S. PATENT DOCUMENTS 9,856,883 B1 * 1/2018 Olsen ..... F04D 25/088
10,309,670 B2 * 6/2019 Kusukame ..... F24F 11/00
2009/0304041 A1 12/2009 Streicher et al.
2016/0054018 A1 2/2016 Motodani et al.
2016/0085248 A1 * 3/2016 Gordon ..... G05D 23/1917 700/276

FOREIGN PATENT DOCUMENTS

JP 2012-215355 A 11/2012
JP 2012215355 A * 11/2012
WO WO 2014/010196 A1 1/2014

OTHER PUBLICATIONS

International Search Report dated Aug. 23, 2016, in PCT/JP2016/065314 filed May 24, 2016.
Office Action dated Aug. 4, 2020 issued in corresponding DE patent application No. 112016006901.4.

* cited by examiner

| PATTERN NO. | FREQUENCY OF OCCURRENCE | LAST UPDATE DATE AND TIME | ELAPSED TIME [MINUTE] | OPERATION STATE | | | AMOUNT OF CHANGE IN WATER VAPOR |
|---|---|---|---|---|---|---|---|
| | | | | DEVICE 30a | DEVICE 30b | DEVICE 30c | |
| 1 | ☆ | ××× | 5 | ○ | △ | □ | A |
| | | | 10 | ○ | △ | □ | B |
| | | | 15 | ○ | △ | □ | C |
| | | | ⋮ | ⋮ | ⋮ | ⋮ | ⋮ |

AIR-CONDITIONING CONTROL DEVICE, AIR-CONDITIONING APPARATUS, AND AIR-CONDITIONING SYSTEM

TECHNICAL FIELD

The present invention relates to an air-conditioning control device, an air-conditioning apparatus, and an air-conditioning system for controlling the state of air in a room.

BACKGROUND ART

Techniques for determining the probability of occurrence of condensation on the basis of the temperature and humidity in a room, which are measured by sensors, to control air-conditioning apparatuses to prevent the occurrence of condensation have been proposed conventionally (see, for example, Patent Literature 1). An air-conditioning apparatus in Patent Literature 1 calculates the current dew-point temperature on the basis of measurement results of the temperature and humidity in a room and performs an anti-condensation operation when it is determined from a history of previous room temperature records that the room temperature reaches a temperature less than or equal to the current dew-point temperature in a predetermined time period. Here, the anti-condensation operation is an operation of reducing the humidity in a room, such as a dehumidification operation and an air-sending operation.

CITATION LIST

Patent Literature

Patent Literature 1: Japanese Unexamined Patent Application Publication No. 2012-215355

SUMMARY OF INVENTION

Technical Problem

The air-conditioning apparatus in Patent Literature 1 performs a uniform anti-condensation operation when a time period taken for a future room temperature to fall below the current dew-point temperature is less than the predetermined time period. Thus, when the amount of water vapor in a room increases during a period from when the anti-condensation operation is started to when a target control time period is reached, the occurrence of condensation is unavoidable.

The present invention has been made to overcome the foregoing issues, and it is an object of the present invention to provide an air-conditioning control device, an air-conditioning apparatus, and an air-conditioning system for prohibiting the occurrence of condensation even when the amount of water vapor in a room is changed.

Solution to Problem

An air-conditioning control device according to one embodiment of the present invention is an air-conditioning control device for controlling an air-conditioning apparatus configured to perform air conditioning of a room in which a device that changes an amount of water vapor is located. The air-conditioning control device includes a memory configured to store device operation data concerning an operation state of the device and a device operation table having an operation time of the device and an amount of change in water vapor in the room in association with each other, a condensation occurrence determiner configured to predict the amount of change in water vapor until after a lapse of a certain amount of time by collating the device operation data with the device operation table and determine whether condensation occurs in the room after the certain amount of time elapses by using the predicted amount of change in water vapor, and an air-conditioning controller configured to change an operation state of the air-conditioning apparatus when the condensation occurrence determiner determines that condensation occurs.

An air-conditioning apparatus according to another embodiment of the present invention includes the air-conditioning control device described above, and is controlled by the air-conditioning control device.

An air-conditioning system according to still another embodiment of the present invention includes the air-conditioning control device described above and a wall temperature sensor configured to measure a wall surface temperature that is a surface temperature of a wall surface portion in the room. The condensation occurrence determiner is configured to determine a dew-point temperature in the room by using the amount of change in water vapor predicted from the device operation table and by using information on the wall surface temperature measured by the wall temperature sensor, and determine that condensation occurs in the room when a predicted temperature of the wall surface temperature after the certain amount of time elapses falls below the dew-point temperature.

Advantageous Effects of Invention

In an embodiment of the present invention, an amount of change in water vapor, which is predicted by collating device operation data with a device operation table, is used to determine whether condensation occurs in a room after a certain amount of time elapses, and the operation of an air-conditioning apparatus is controlled on the basis of the determination result. As the operation state of the air-conditioning apparatus is controllable depending on a change in the amount of water vapor in the room, the occurrence of condensation can be prohibited even when the amount of water vapor in the room is changed.

DESCRIPTION OF EMBODIMENTS

Embodiment 1

Figure 1:
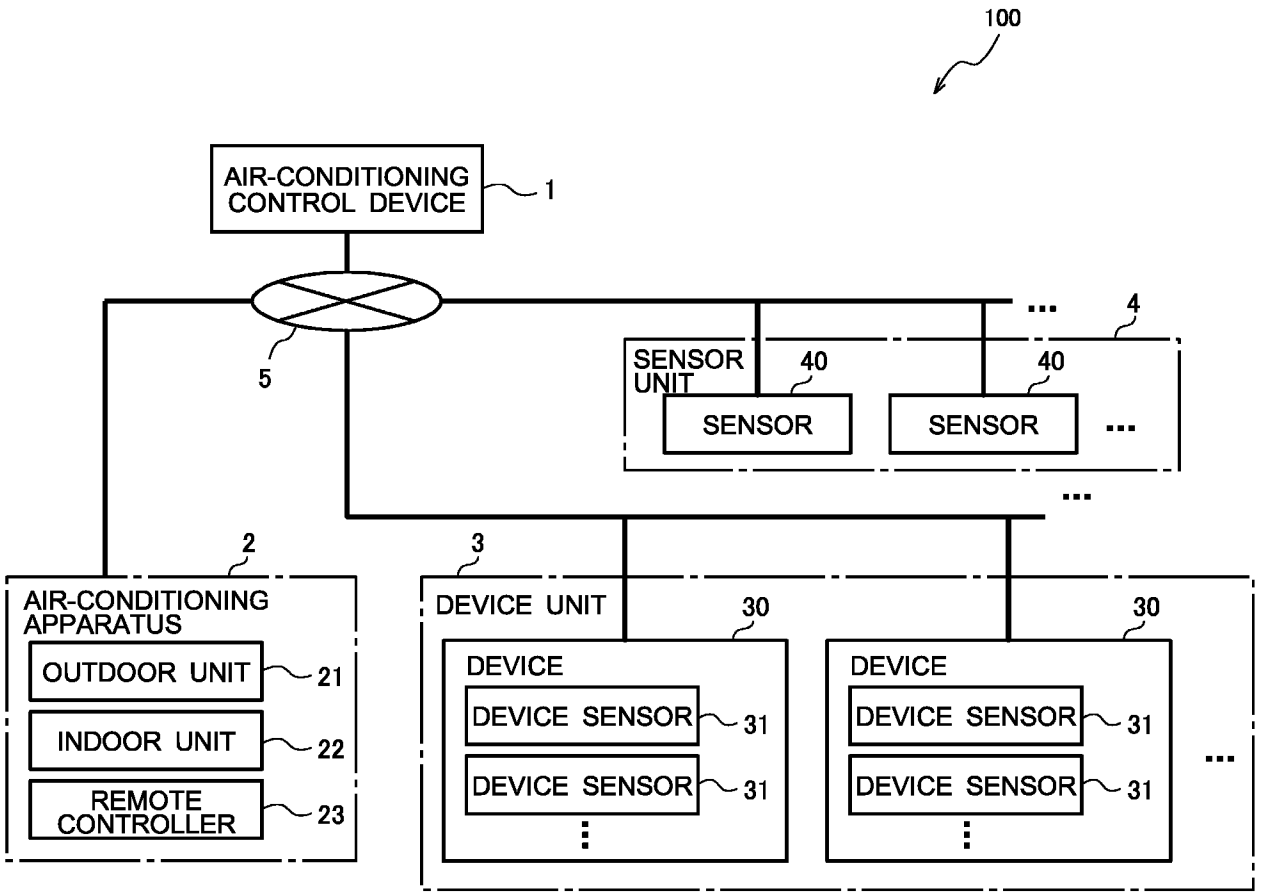
FIG. 1 is a block diagram illustrating a configuration of an air-conditioning system including an air-conditioning control device according to Embodiment 1 of the present invention.

FIG. 1 is a block diagram illustrating a configuration of an air-conditioning system including an air-conditioning control device according to Embodiment 1 of the present invention. In FIG. 1, an example configuration is illustrated in which an air-conditioning control device 1 is connected to an air-conditioning apparatus 2, a device unit 3, and a sensor unit 4 via a control network 5. That is, an air-conditioning system 100 includes the air-conditioning control device 1, the air-conditioning apparatus 2, the device unit 3, and the sensor unit 4.

The device unit 3 is an electric power consuming device other than an air-conditioning apparatus and includes one or more devices 30. For example, when the air-conditioning system 100 including the air-conditioning control device 1 is intended for home use, examples of the devices 30 include a cooking device, a lighting device, a ventilation device, a humidifier-dehumidifier, and a ventilation fan. Each of the devices 30 includes one or more device sensors 31, each detecting the state of the device 30. In the following, the one or more devices 30 are also referred to simply as the device 30 or the devices 30.

The sensor unit 4 includes one or more sensors 40 that measure a physical quantity. Each sensor 40 is, for example, a sensor that measures a temperature, a humidity, a radiation temperature, or other factor. That is, examples of the sensor unit 4 include, as the plurality of sensors 40, a temperature sensor that measures a temperature, a humidity sensor that measures a humidity, and a radiation temperature sensor that measures a radiation temperature. The radiation temperature sensor serves as, for example, a wall temperature sensor that measures a wall surface temperature, which is a surface temperature of a wall surface portion in a room. In the following, the one or more sensors 40 are also referred to simply as the sensor 40 or the sensors 40.

The air-conditioning apparatus 2 includes an outdoor unit 21, an indoor unit 22, and a remote controller 23. The outdoor unit 21 cools or heats a heat medium such as refrigerant and water. The indoor unit 22 allows heat exchange between the heat medium and the air in a room to control the temperature in the room. The outdoor unit 21 and the indoor unit 22 are connected to each other via a pipe in which the heat medium circulates to form a refrigeration cycle. The air-conditioning apparatus 2 is desirably a heat pump air-conditioning apparatus that efficiently cools or heats a heat medium by utilizing heat in the outside air.

The remote controller 23 is a device with which a user turns on or off the power and manually changes settings such as a target temperature, an amount of airflow, and an airflow direction. That is, the remote controller 23 accepts an input operation performed by the user to control the air-conditioning apparatus 2. The remote controller 23 has a function of communicating with the air-conditioning apparatus 2 in a wired or wireless manner and transmits user operation information indicating the content of the input operation by the user to the air-conditioning apparatus 2. The air-conditioning apparatus 2 is configured to transmit the user operation information received from the remote controller 23 to the air-conditioning control device 1.

When the air-conditioning system 100 is configured for home use, one indoor unit 22 is commonly installed in each room. For example, a room air conditioner is a typical example of the air-conditioning apparatus 2. It should be noted that the air-conditioning apparatus 2 may be of a type in which a plurality of indoor units 22 are connected to a single outdoor unit 21. Alternatively, the air-conditioning apparatus 2 may be an integrated air-conditioning apparatus having both the function of the outdoor unit 21 and the function of the indoor unit 22. The air-conditioning system 100 may include a plurality of air-conditioning apparatuses 2.

The air-conditioning control device 1 controls the air-conditioning apparatus 2 that performs air conditioning of a room in which the devices 30 that change the amount of water vapor are located. When the device unit 3 includes one device 30, the amount of water vapor in the room is changed depending on the operation state of the device 30. When the water vapor in the room is changed to increase or the temperature in the room is reduced as a result of the operation of the device 30, condensation may occur in the room. When the device unit 3 includes a plurality of devices 30, each of the devices 30 operates while individually switching between an activation state and a deactivation state. When a change in the operation state of each of the devices 30 causes a change such a manner that the water vapor in the room increases or causes a reduction in the temperature in the room, condensation may occur in the room. To solve this problem, the air-conditioning control device 1 controls the operation of the air-conditioning apparatus 2 on the basis of the amount of change in water vapor in the room not to cause condensation in the room. In the following, control of the air-conditioning apparatus 2 that is performed by the air-conditioning control device 1 to prevent condensation in a room before it occurs is referred to as anti-condensation control. When a sensor that measures a temperature, a humidity, a radiation temperature, or other factor is included in the air-conditioning apparatus 2, the air-conditioning control device 1 may use detection information obtained by the sensor in the air-conditioning apparatus 2 for anti-condensation control.

The control network 5 is a communication network for connecting the air-conditioning control device 1, the air-conditioning apparatus 2, the device unit 3, and the sensor unit 4 to each other. In Embodiment 1, the control network 5 is not limited to any specific type in terms of the cable type, communication protocol, and other aspects. That is, the control network 5 may support wired communication such as a LAN and wireless communication such as a wireless LAN, infrared communication, and Bluetooth (registered trademark). The control network 5 may also support a general-purpose protocol available to the public or may support dedicated lines, dedicated protocols, and other standard prepared by the manufacturers of the air-conditioning apparatus 2 and the devices 30.

The air-conditioning system 100 may not necessarily include the air-conditioning apparatus 2 or the device unit 3 and may be constituted by the air-conditioning control device 1 and the sensor unit 4. Alternatively, the air-conditioning system 100 may include any one of the device unit 3 and the sensor unit 4.

Figure 2:
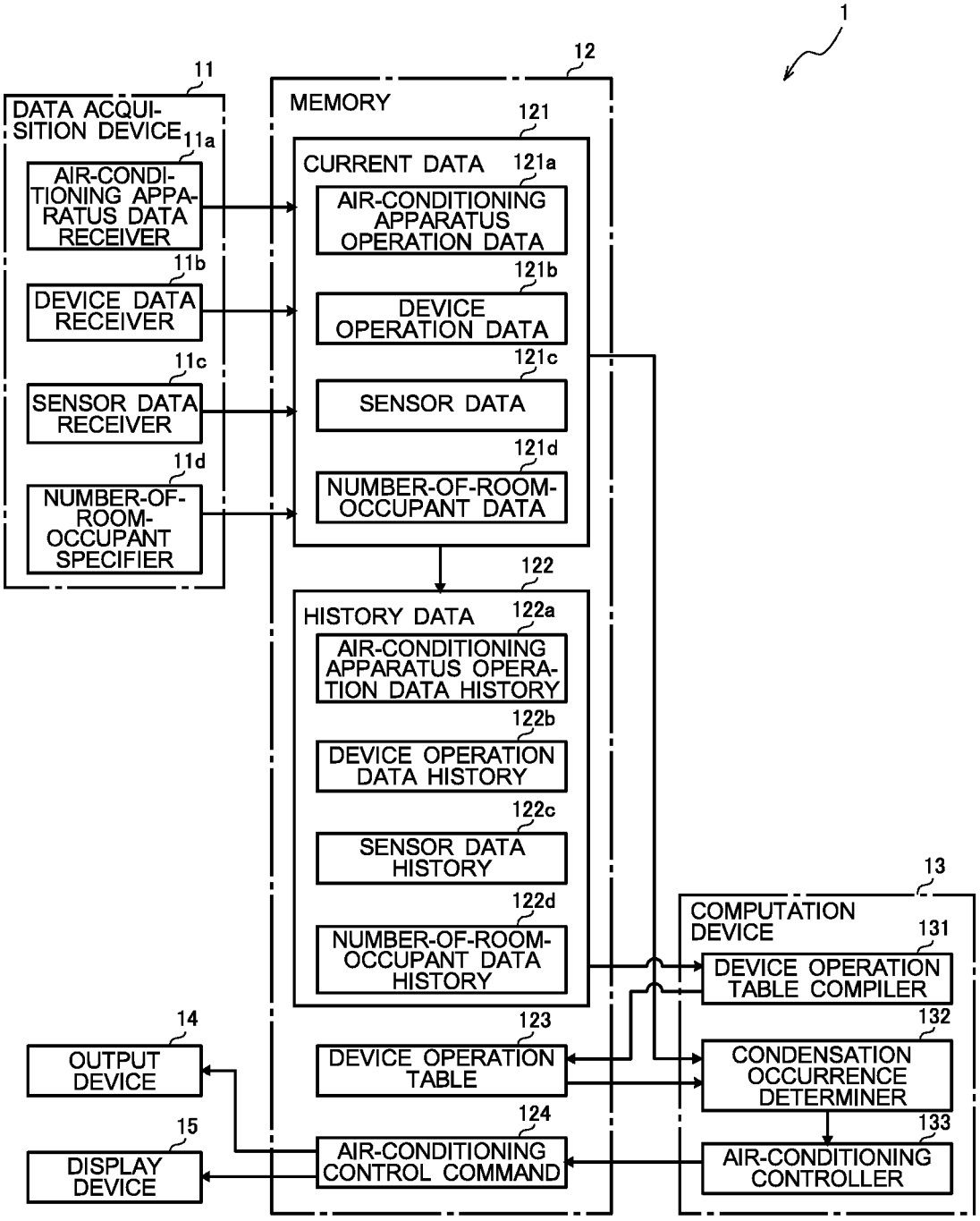
FIG. 2 is a block diagram illustrating a functional configuration of the air-conditioning control device in FIG. 1.
Figures 3, 4:
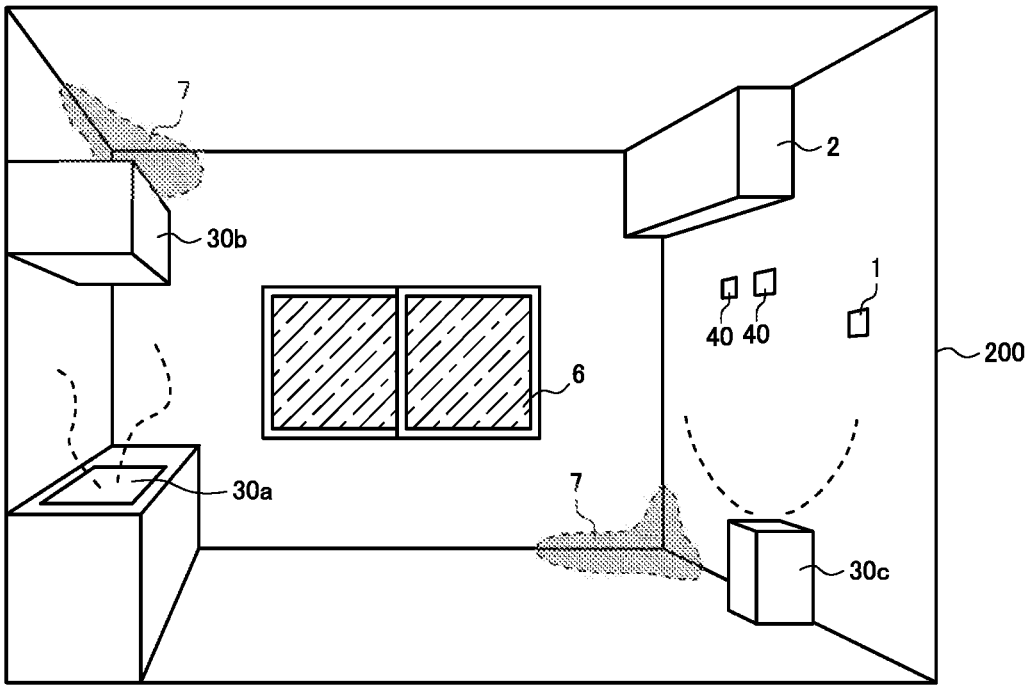
FIG. 3 is a diagram exemplifying a pattern included in a device operation table in FIG. 2.
FIG. 4 is a schematic diagram exemplifying an air-conditioned space where the air-conditioning system in FIG. 1 is installed.

FIG. 2 is a block diagram illustrating a functional configuration of the air-conditioning control device 1 in FIG. 1. FIG. 3 is a diagram exemplifying a pattern included in a device operation table in FIG. 2. The following describes a detailed configuration of the air-conditioning control device 1 with reference to FIG. 2 and FIG. 3. As illustrated in FIG.

2, the air-conditioning control device 1 includes a data acquisition device 11, a memory 12, a computation device 13, an output device 14, and a display device 15.

The data acquisition device 11 acquires current data 121 at a predetermined detection interval and stores the current data 121 in the memory 12. The data acquisition device 11 includes an air-conditioning apparatus data receiver 11*a*, a device data receiver 11*b*, a sensor data receiver 11*c*, and a number-of-room-occupant specifier 11*d*. The detection interval can be set to a desired interval and can be changed.

The air-conditioning apparatus data receiver 11*a* receives air-conditioning apparatus operation data 121*a* from the air-conditioning apparatus 2 and stores the air-conditioning apparatus operation data 121*a* in the memory 12. The air-conditioning apparatus data receiver 11*a* receives, as the air-conditioning apparatus operation data 121*a*, operation data indicating the operation state of the air-conditioning apparatus 2, user operation information obtained by the remote controller 23, and activation-deactivation information indicating whether the air-conditioning apparatus 2 is in the activation state or in the deactivation state. When the air-conditioning apparatus 2 includes various sensors, the air-conditioning apparatus data receiver 11*a* receives detection information obtained by the various sensors of the air-conditioning apparatus 2 and stores the detection information in the memory 12.

The device data receiver 11*b* receives device operation data 121*b*, which is information concerning the operation state of the device 30, from the device unit 3 and stores the device operation data 121*b* in the memory 12. The device data receiver 11*b* receives, as the device operation data 121*b*, at least one of operation data indicating the operation state of each device 30, user operation information indicating the content of an operation performed by the user, and detection data indicating detection results obtained by the device sensor 31. For example, when the device 30 is an IH cooker such as an IH cooking stove, examples of the device operation data 121*b* include activation-deactivation information indicating whether the device 30 is in the activation state or in the deactivation state, data such as the output of the device 30, and information on the temperature measured in the device 30.

The sensor data receiver 11*c* receives sensor data 121*c* from the sensor 40 installed indoor or outdoor and stores the sensor data 121*c* in the memory 12. The sensor data 121*c* is information indicating a detection result obtained by the sensor 40 and is, for example, information such as a temperature, a humidity, and a radiation temperature. That is, the sensor data 121*c* includes information on the water vapor in the room.

The number-of-room-occupant specifier 11*d* specifies the number of occupants in the room and stores information on the specified number of occupants in the memory 12 as number-of-room-occupant data 121*d*. For example, the number-of-room-occupant specifier 11*d* may acquire an image captured by a camera or other similar device placed in the room and detect a person in the acquired image to specify the number of occupants in the room. In this case, the camera or other similar device may be mounted in the air-conditioning control device 1 or the air-conditioning apparatus 2, may be mounted in another electrical device installed in the room, or may be disposed in the room.

Alternatively, for example, each user may carry a transmitter and the number-of-room-occupant specifier 11*d* may detect the number of transmitters present in the room to specify the number of occupants in the room. Alternatively, for example, the number-of-room-occupant specifier 11*d* may include a communication unit having a function of performing short-range communication. The communication unit may detect a radio wave from a mobile terminal carried by a person in the room, and accordingly the number-of-room-occupant specifier 11*d* may specify the number of occupants in the room. Each mobile terminal is a terminal that can be carried by a user, such as a mobile phone, a smartphone, a tablet PC, and a notebook PC. A radio wave from each mobile terminal is a radio wave emitted from the mobile terminal when the short-range communication function is enabled.

The memory 12 acquires the air-conditioning apparatus operation data 121*a*, the device operation data 121*b*, the sensor data 121*c*, and the number-of-room-occupant data 121*d* through the data acquisition device 11 and stores the air-conditioning apparatus operation data 121*a*, the device operation data 121*b*, the sensor data 121*c*, and the number-of-room-occupant data 121*d* as the current data 121. The memory 12 also accumulates pieces of the current data 121 over a predetermined period in the past as history data 122. That is, the memory 12 accumulates pieces of the current data 121, which is acquired through the data acquisition device 11, over time as the history data 122.

The history data 122 includes an air-conditioning apparatus operation data history 122*a*, a device operation data history 122*b*, a sensor data history 122*c*, and a number-of-room-occupant data history 122*d*. The air-conditioning apparatus operation data history 122*a* chronologically stores a plurality of pieces of air-conditioning apparatus operation data 121*a* obtained over a period from a predetermined time ago to the present. The device operation data history 122*b* chronologically stores a plurality of pieces of device operation data 121*b* obtained over a period from a predetermined time ago to the present. The sensor data history 122*c* chronologically stores a plurality of pieces of sensor data 121*c* obtained over a period from a predetermined time ago to the present. The number-of-room-occupant data history 122*d* chronologically stores a plurality of pieces of number-of-room-occupant data 121*d* obtained over a period from a predetermined time ago to the present. The history data 122 is input to a device operation table compiler 131 included in the computation device 13.

The memory 12 further stores a device operation table 123 created by the device operation table compiler 131 and an air-conditioning control command 124 issued by an air-conditioning controller 133. The device operation table 123 is table information in which an operation time of the device 30 and an amount of change in water vapor in the room are associated with each other. The amount of change in water vapor in the room is information on the amount of water vapor in the room that changes until after the lapse of a certain amount of time as a result of the operation of the device 30, and is hereinafter also referred to simply as an "amount of change in water vapor". That is, the device operation table 123 is information indicating a correlation between the operation state of the device 30 and the state of the air in the room.

For example, as illustrated in FIG. 3, the device operation table 123 is organized by "PATTERN NO.", which is the number of a pattern, "FREQUENCY OF OCCURRENCE", which is information on the number of occurrences of the pattern, and "LAST UPDATE DATE AND TIME", which is the date and time at which the pattern is last updated. The device operation table 123 stores, as time-series data of each pattern, the operation state of the device 30 and an amount of change in water vapor until after the lapse of a certain amount of time. That is, each of the patterns included in the device operation table 123 is chronologically organized in association with the devices 30 in operation and their durations of operation, the frequency of occurrence, the last update date and time, the amounts of change in water vapor, and other information. In the example illustrated in FIG. 3, the device operation table 123 stores an amount of change in water vapor until after the lapse of a certain amount of time, such as an amount of change in water vapor until after 5 minutes, 10 minutes, or 15 minutes.

In the patterns illustrated in FIG. 3, elapsed times are set in increments of 5 minutes and pieces of time-series data are stored every 5 minutes, by way of example, but not limitation. The elapsed times may be set in increments of any duration and may not necessarily be set at equal intervals. While FIG. 3 exemplifies only one pattern in the device operation table 123, the device operation table 123 stores a plurality of patterns. When the device unit 3 includes the devices 30 whose operation states are controllable, that is, the devices 30 whose operation states are stepwise controllable, the devices 30 whose operation states are linearly controllable, or other types of devices 30, patterns are set in terms of combinations of the operation states of the devices 30 as well.

The computation device 13 is constituted by, for example, a processor and includes the device operation table compiler 131, a condensation occurrence determiner 132, and the air-conditioning controller 133. The device operation table compiler 131 acquires the predetermined history data 122 from the memory 12 and creates the device operation table 123 through learning computation. That is, the device operation table compiler 131 performs a learning process on the amounts of change in water vapor stored in the device operation table 123 by using the device operation data history 122*b* and the sensor data history 122*c*. The device operation table compiler 131 performs learning computation each time the current data 121 is stored in the memory 12 and the history data 122 is updated, and updates the content of the device operation table 123.

The condensation occurrence determiner 132 predicts an amount of change in water vapor in the room until after the lapse of a certain amount of time depending on the operation state of the device 30 on the basis of the device operation table 123 and the current data 121 in the memory 12. The condensation occurrence determiner 132 further determines whether condensation occurs in the room after a certain amount of time elapses by using the predicted amount of change in water vapor. Further, the condensation occurrence determiner 132 outputs a determination result to the air-conditioning controller 133.

When the device unit 3 includes a plurality of devices 30, the condensation occurrence determiner 132 determines whether the device operation table 123 has a pattern that matches a combination of the current operation states of the devices 30 included in the device operation data 121*b*. When the device operation table 123 has the matching pattern, the condensation occurrence determiner 132 acquires the amount of change in water vapor associated with the pattern from the device operation table 123.

The condensation occurrence determiner 132 can acquire an amount of change in water vapor after 5 minutes, 10 minutes, 15 minutes, or other time from the pattern in the device operation table 123 illustrated in FIG. 3. In FIG. 3, the amount of change in water vapor after 5 minutes corresponds to "A", the amount of change in water vapor after 10 minutes corresponds to "B", and the amount of change in water vapor after 15 minutes corresponds to "C". Unlike the example in FIG. 3, when the elapsed times in the device operation table 123 are not set at equal intervals or are more finely set, the condensation occurrence determiner 132 can determine an amount of change in water vapor until after the lapse of a certain irregular amount of time such as after 5 minutes, 8 minutes, and 10 minutes.

Further, the condensation occurrence determiner 132 determines the current amount of water vapor in the room from the air-conditioning apparatus operation data 121*a* and the sensor data 121*c*. The condensation occurrence determiner 132 further adds the amount of change in water vapor acquired from the device operation table 123 to the current amount of water vapor in the room to determine an achievable amount of water vapor, which is a predicted value of the amount of water vapor in the room after a certain amount of time elapses.

The condensation occurrence determiner 132 may have a function of determining an amount of occupant-generated water vapor, which is an amount of water vapor generated from the human body until a certain amount of time elapses, by using the number of occupants indicated in the number-of-room-occupant data 121*d* and the amount of water vapor generated per occupant in the certain amount of time. In this case, the condensation occurrence determiner 132 desirably multiplies the amount of water vapor generated per occupant in the certain amount of time by the number of occupants indicated in the number-of-room-occupant data 121*d* to determine an amount of occupant-generated water vapor. In the following, an amount of water vapor generated per occupant in a certain amount of time, that is, an amount of water vapor generated from one person in the room until a certain amount of time elapses, is referred to as a "unit amount of generated water vapor". The unit amount of generated water vapor is set in advance and is stored in an internal memory or other similar device (not illustrated) of the memory 12 or the computation device 13. The condensation occurrence determiner 132 may add the amount of change in water vapor and the amount of occupant-generated water vapor to the current amount of water vapor in the room to determine an achievable amount of water vapor.

Further, the condensation occurrence determiner 132 determines a dew-point temperature in the room on the basis of the achievable amount of water vapor. Further, the condensation occurrence determiner 132 determines whether the room temperature falls below the dew-point temperature after a certain amount of time elapses. This determination corresponds to determination of whether condensation occurs in the room. When the sensor unit 4 includes a radiation temperature sensor as the sensor 40, the sensor data receiver 11*c* acquires a wall surface temperature, which is information on the temperature of a surface of a wall, as the sensor data 121*c*. Then, the condensation occurrence determiner 132 determines whether the determined dew-point temperature falls below a temperature of the wall surface temperature that is predicted after a certain amount of time elapses. Further, the condensation occurrence determiner 132 may analyze the wall surface temperature and individually acquire information on the temperature of each portion in the room, such as a window surface and a wall surface. In this case, the condensation occurrence determiner 132 determines whether a predicted temperature of each portion falls below the dew-point temperature after the certain amount of time elapses.

When the device operation table 123 does not have a pattern that matches a combination of the current operation states of the devices 30 included in the device operation data 121*b*, the condensation occurrence determiner 132 may perform no processing and wait for the next detection timing. The condensation occurrence determiner 132 may also perform no processing and wait for the next detection timing when the matching pattern is found but the frequency of occurrence associated with the found pattern is less than or equal to a predetermined threshold. The threshold used for comparison in terms of frequency of occurrence is set in advance as a reference of likelihood that each device 30 continues the operation state to follow the pattern in future. That is, when the frequency of occurrence exceeds the threshold, it can be determined that the device 30 currently in operation will probably operate to follow the pattern in future and that the device 30 currently not in operation will probably continue the non-operation state.

The air-conditioning controller 133 determines the content of the control of the air-conditioning apparatus 2 on the basis of the amount of change in water vapor, which is predicted by the condensation occurrence determiner 132, and stores the air-conditioning control command 124 indicating the determined content of the control in the memory 12. More specifically, when the condensation occurrence determiner 132 determines that condensation occurs, the air-conditioning controller 133 changes the operation state of the air-conditioning apparatus 2 so that the temperature in the room or other temperature becomes greater than or equal to the dew-point temperature after a certain amount of time elapses. The air-conditioning controller 133 is configured to perform anti-condensation control to control the airflow direction, the amount of airflow, the set temperature, and other aspect of the air-conditioning apparatus 2.

When the sensor unit 4 includes a radiation temperature sensor as the sensor 40, the air-conditioning controller 133 can control the operation of the air-conditioning apparatus 2 so that the surface temperature of a portion of the wall surface portion where condensation is determined to occur by the condensation occurrence determiner 132 becomes greater than or equal to the dew-point temperature after a certain amount of time elapses. The air-conditioning controller 133 may perform anti-condensation control to change the content of the control of the air-conditioning apparatus 2 stepwise. For example, the air-conditioning controller 133 may first change the set temperature of the air-conditioning apparatus 2 within a comfort temperature range. Then, when the wall surface temperature does not exceed the dew-point temperature even though the set temperature is changed, the air-conditioning controller 133 may change the airflow direction toward a portion where condensation can occur and may further increase the amount of airflow by one level. The comfort temperature range may be set as a variable temperature range in advance. Alternatively, the comfort temperature range may be determined on the basis of a PMV (Predicted Mean Vote) calculated by the air-conditioning controller 133 by using the sensor data 121*c*.

The output device 14 reads the air-conditioning control command 124 from the memory 12 and transmits a control command to the air-conditioning apparatus 2, which is a control target, in accordance with the air-conditioning control command 124. The air-conditioning apparatus 2 is configured to operate in accordance with the control command transmitted from the output device 14.

The display device 15 includes, for example, a liquid crystal display and displays information on the control state of the air-conditioning apparatus 2 based on the air-conditioning control command 124 stored in the memory 12. For example, when the air-conditioning apparatus 2 is automatically controlled, the display device 15 displays information indicating, for example, how the control state is changed.

The air-conditioning control device 1 may be implemented by hardware such as a circuit device that implements the functions described above or may be implemented as software to be executed on a microprocessor such as a digital signal processor (DSP) and on a computation device such as a central processing unit (CPU). Also, a hard disk drive (HDD), a flash memory, or other similar device can be used as the memory 12.

FIG. 4 is a schematic diagram exemplifying an air-conditioned space where the air-conditioning system 100 in FIG. 1 is installed. That is, as illustrated in FIG. 4, the air-conditioning system 100 in Embodiment 1 is assumed to be installed in a room 200 such as a dining-kitchen room in a house. In FIG. 4, for simplicity of illustration, one air-conditioning apparatus 2 and the device unit 3 including three devices 30 are illustrated by way of example. In FIG. 4, furthermore, two sensors 40 constituting the sensor unit 4 are connected to the air-conditioning control device 1 in a wired or wireless manner.

In the situation illustrated in FIG. 4, the air-conditioning control device 1 predicts a future amount of change in water vapor in the room 200 from the device operation data 121*b*, which is information concerning the operation states of the plurality of devices 30, namely, an IH cooker 30*a*, a ventilation fan 30*b*, and a humidifier 30*c*. The air-conditioning control device 1 further determines whether condensation occurs by using the predicted amount of change in water vapor. When it is determined that condensation will occur, the air-conditioning control device 1 performs anti-condensation control on the air-conditioning apparatus 2 in the room 200 to prevent condensation before it occurs.

The IH cooker 30*a*, the ventilation fan 30*b*, and the humidifier 30*c* are devices that change the amount of water vapor in a room. More specifically, the IH cooker 30*a* and the humidifier 30*c* are devices that generate water vapor. The ventilation fan 30*b* is a device that ventilates a room to have air in the room and air from the outside exchanged, and discharges air in the room to the outside to discharge the water vapor in the room to the outside. When air having a lower humidity than that of the indoor air is sucked as a result of ventilation, the ventilation fan 30*b* reduces the water vapor in the room. In contrast, when air having a higher humidity than that of the indoor air is sucked as a result of ventilation, the ventilation fan 30*b* increases the water vapor in the room. That is, when a change in the operation states of the IH cooker 30*a*, the ventilation fan 30*b*, and the humidifier 30*c* causes a change such a manner that the water vapor in the room 200 increases or causes a reduction in the temperature in the room 200, the vapor pressure in the room 200 exceeds the saturated vapor pressure of water and condensation can occur.

In FIG. 4, the air-conditioning apparatus 2 includes a temperature sensor (not illustrated) that measures an inlet temperature, one of the sensors 40 is a humidity sensor that measures a humidity, and the other sensor 40 is an infrared camera. Thus, the air-conditioning control device 1 acquires information on the inlet temperature of the air-conditioning apparatus 2 from the temperature sensor of the air-conditioning apparatus 2 as information included in the air-conditioning apparatus operation data 121*a*. The air-conditioning control device 1 further acquires humidity data indicating the humidity of the room 200 from the one sensor 40. Then, the air-conditioning control device 1 divides an image acquired from the infrared camera serving as the other sensor 40 into sections of predetermined distances and performs averaging over the sections to obtain a wall surface temperature.

The wall surface temperature is commonly lower in portions having lower heat insulating properties, such as a window 6 and corner portions 7 illustrated in FIG. 4, than in the other wall surface portions. In this respect, when the air-conditioning system 100 includes an infrared camera as the sensor 40, the air-conditioning control device 1 can acquire, as wall surface temperatures, the temperatures of portions on the wall surface. Thus, the air-conditioning control device 1 can determine whether condensation occurs for each portion on the wall surface. The air-conditioning control device 1 controls the operation of the air-conditioning apparatus 2 on the basis of the determination results, thereby being able to prohibit the occurrence of condensation.

With the configuration described above, the air-conditioning control device 1 predicts a future amount of change in water vapor in the room at a predetermined detection interval. Thus, the air-conditioning control device 1 can accurately determine whether condensation occurs when a user operates the devices 30 that can change the amount of water vapor, such as a cooking device, a ventilation device, a dehumidifier, and a humidifier or when the number of occupants in the room changes. That is, the air-conditioning control device 1 changes the operation state of the air-conditioning apparatus 2 while taking into account the predicted result of the future amount of change in water vapor in the room and a temperature distribution along the wall surface, thereby preventing condensation before it occurs. Consequently, the air-conditioning control device 1 can avoid conditions such as defilement and insanitation caused by mold growth on the interior of a room due to condensation water.

Figure 5:
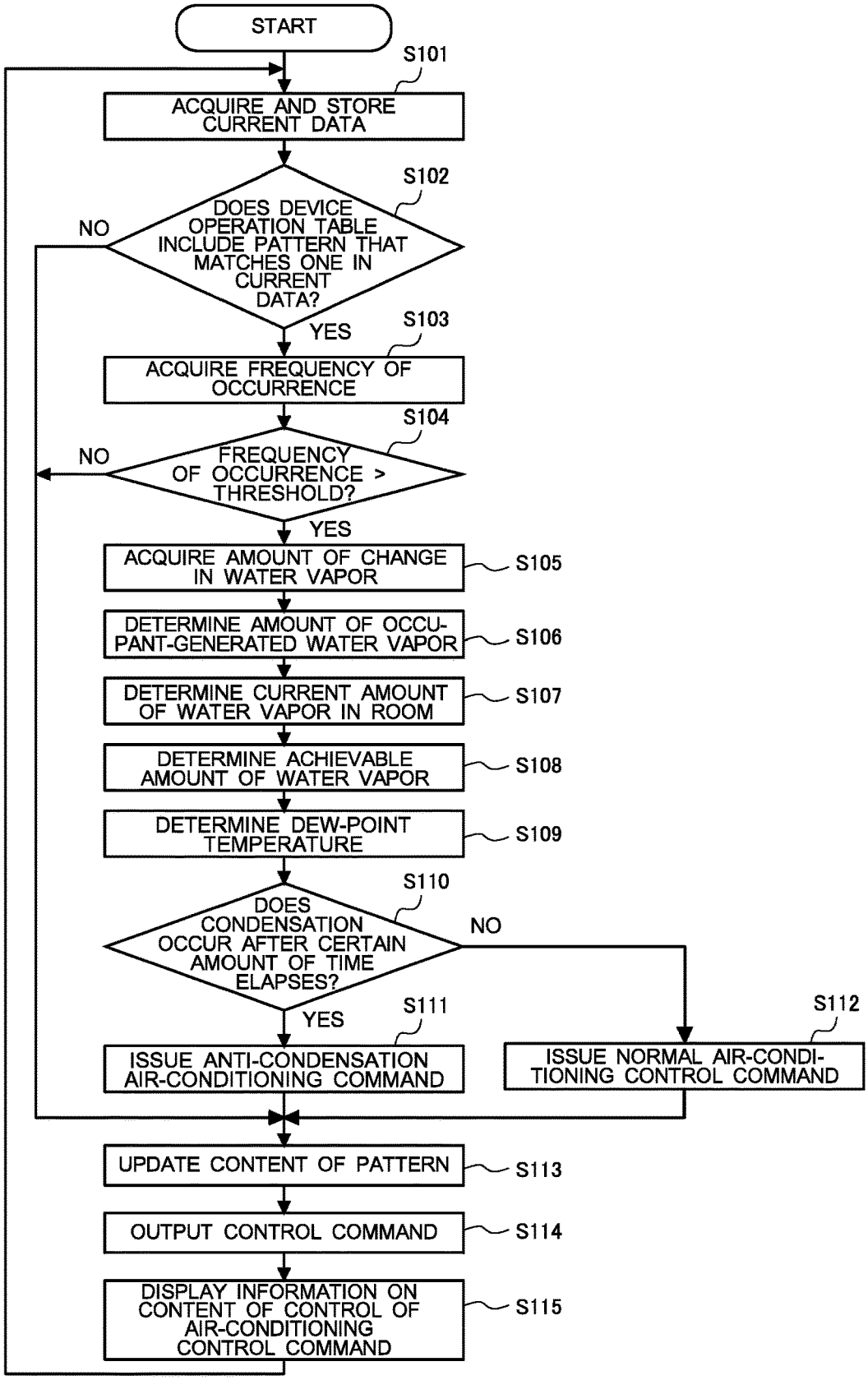
FIG. 5 is a flowchart illustrating an example operation for anti-condensation control of the air-conditioning control device 1 in FIG. 1.

FIG. 5 is a flowchart illustrating an example operation of the air-conditioning control device 1 in FIG. 1 for anti-condensation control. With reference to FIG. 5, the content of the anti-condensation control performed by the air-conditioning control device 1 will be described where the air-conditioning system 100 includes a plurality of devices 30. A pattern creation method performed by the device operation table compiler 131 will be described below with reference to FIG. 6.

First, the data acquisition device 11 acquires the current data 121 at a predetermined detection interval and stores the acquired current data 121 in the memory 12 (FIG. 5, step S101). Then, the condensation occurrence determiner 132 collates the current data 121 stored in the memory 12 by the data acquisition device 11 with the device operation table 123 to determine whether the device operation table 123 includes a pattern that matches one in the current data 121. That is, the condensation occurrence determiner 132 searches the device operation table 123 for a pattern that matches a combination of the current operation states of the devices 30 included in the device operation data 121*b* (FIG. 5, step S102). When the condensation occurrence determiner 132 does not detect a pattern that matches any in the current data 121 (FIG. 5, NO in step S102), the process proceeds to step S113.

When the pattern that matches one in the current data 121 is detected (FIG. 5, YES in step S102), the condensation occurrence determiner 132 acquires the frequency of occurrence associated with the detected pattern from the device operation table 123 (FIG. 5, step S103). Then, the condensation occurrence determiner 132 determines whether the acquired frequency of occurrence exceeds a predetermined threshold (FIG. 5, step S104). When the condensation occurrence determiner 132 determines that the acquired frequency of occurrence is less than or equal to the threshold (FIG. 5, NO in step S104), the process proceeds to step S113.

When the frequency of occurrence exceeds the threshold (FIG. 5, YES in step S104), the condensation occurrence determiner 132 determines that each of the devices 30 continues the operation state to follow the pattern in future, and acquires the amount of change in water vapor associated with the pattern detected in step S102 (FIG. 5, step S105). Further, the condensation occurrence determiner 132 determines that the number-of-room-occupant data 121*d* in the current data 121 is still maintained in future, and multiplies the unit amount of generated water vapor by the number of occupants indicated in the number-of-room-occupant data 121*d* to determine an amount of occupant-generated water vapor, which is an amount of change in water vapor resulting from occupants (FIG. 5, step S106). Further, the condensation occurrence determiner 132 determines, from information on the room temperature and humidity included in the air-conditioning apparatus operation data 121*a* and the sensor data 121*c* stored in step S101, the current amount of water vapor in the room (FIG. 5, step S107).

Then, the condensation occurrence determiner 132 adds the amount of change in water vapor acquired in step S105 and the amount of occupant-generated water vapor determined in step S106 to the current amount of water vapor in the room determined in step S107 to determine an achievable amount of water vapor, which is a predicted value of the amount of water vapor in the room after a certain amount of time elapses (FIG. 5, step S108). Then, the condensation occurrence determiner 132 determines a dew-point temperature of each portion in the room, namely, the window surface and the wall surface, on the basis of the achievable amount of water vapor (FIG. 5, step S109).

Subsequently, the condensation occurrence determiner 132 determines whether a predicted wall surface temperature, which is a predicted temperature of the wall surface temperature after the certain amount of time elapses, falls below the dew-point temperature determined in step S109. Consequently, the condensation occurrence determiner 132 determines whether condensation occurs in any portion in the room of the window surface and the wall surface, after the certain amount of time elapses (FIG. 5, step S110).

In step S110, the condensation occurrence determiner 132 may determine that the change in wall surface temperature over time is small and may use the wall surface temperature in the current data 121 as is as the predicted wall surface temperature. Further, the condensation occurrence determiner 132 may determine a rate of change in wall surface temperature from the history data 122 and correct the current wall surface temperature on the basis of the determined rate of change to determine a predicted wall surface temperature. In addition, the condensation occurrence determiner 132 may use, as a predicted wall surface temperature, a temperature predicted using a thermal model of a wall or other factor.

Then, when the condensation occurrence determiner 132 determines that condensation occurs (FIG. 5, YES in step S110), the air-conditioning controller 133 controls the operation of the air-conditioning apparatus 2 so that the surface temperature of a portion of the wall surface portion where condensation is determined to occur becomes greater than or equal to the dew-point temperature after the certain amount of time elapses. That is, the air-conditioning controller 133 determines the content of change in the operation state of the air-conditioning apparatus 2 and issues an anti-condensation air-conditioning command depending on the determined content of the change. Then, the air-conditioning controller 133 stores the issued anti-condensation air-conditioning command in the memory 12 as the air-conditioning control command 124 (FIG. 5, step S111).

Here, the airflow direction, the amount of airflow, the set temperature, and other aspect of the air-conditioning apparatus 2 are to be changed in accordance with the anti-condensation air-conditioning command. The air-conditioning controller 133 may combine a change in the airflow direction setting, a change in the amount-of-airflow setting, and a change in the set temperature of the air-conditioning apparatus 2 to issue an anti-condensation air-conditioning command to change the content of the control stepwise. For example, the air-conditioning controller 133 may change the set temperature within a comfort temperature range and change the airflow direction toward a portion where condensation can occur when the surface temperature of the portion of the wall surface portion where condensation is determined to occur does not exceed the dew-point temperature even when the set temperature is changed. Then, when the surface temperature of the portion of the wall surface portion where condensation is determined to occur does not exceed the dew-point temperature even when the airflow direction setting is changed, the air-conditioning controller 133 may change the amount-of-airflow setting depending on, for example, a difference between a predicted temperature of the portion after the certain amount of time elapses and the dew-point temperature, and may increase the amount of airflow.

On the other hand, when the condensation occurrence determiner 132 determines that no condensation occurs (FIG. 5, NO in step S110), the air-conditioning controller 133 issues a normal air-conditioning control command indicating the content of the control of the air-conditioning apparatus 2 in a normal state. Then, the air-conditioning controller 133 stores the issued normal air-conditioning control command in the memory 12 as the air-conditioning control command 124 (FIG. 5, step S112).

Then, the device operation table compiler 131 updates the content of the patterns in the device operation table 123. That is, the device operation table compiler 131 organizes the history data 122 over a predetermined period, which is stored until the present time, as patterns and stores the patterns in the device operation table 123 (FIG. 5, step S113).

The output device 14 reads the air-conditioning control command 124 from the memory 12. Then, the output device 14 issues a control command in accordance with the air-conditioning control command 124 and outputs the issued control command to the air-conditioning apparatus 2 (FIG. 5, step S114). The display device 15 reads the air-conditioning control command 124 from the memory 12. Then, the display device 15 displays information on the content of the control of the air-conditioning control command 124, that is, information on the current control state obtained by the air-conditioning controller 133 (FIG. 5, step S115), and then the process returns to step S101. That is, the air-conditioning control device 1 periodically executes a series of processes illustrated in steps S101 to S115 in FIG. 5 at a predetermined detection interval.

The operation has been described above in the order of step numbers in FIG. 5, but the order is not limited to this order. For example, any of the processes in steps S105 to S107 may be performed first. Likewise, any of the processes in steps S113 to S115 may be performed first. In the foregoing description, the display device 15 reads the air-conditioning control command 124 from the memory 12, by way of example, but not limitation. For example, a control unit such as the air-conditioning controller 133 may cause the display device 15 to display information on the content of the control of the air-conditioning control command 124.

In FIG. 5, additionally, the condensation occurrence determiner 132 adds the amount of change in water vapor and the amount of occupant-generated water vapor to the current amount of water vapor in the room to determine an achievable amount of water vapor, by way of example, but not limitation. For example, the condensation occurrence determiner 132 may first determine, as a total amount of change in water vapor, an amount of change in water vapor in the room over a period from the present time until a certain amount of time elapses. That is, the condensation occurrence determiner 132 may add an amount of occupant-generated water vapor, which is determined by multiplying the unit amount of generated water vapor by the number of occupants indicated in the number-of-room-occupant data 121*d*, to the amount of change in water vapor acquired from the device operation table 123 to predict a total amount of change in water vapor until after the lapse of a certain amount of time. Then, the condensation occurrence determiner 132 may add the predicted total amount of change in water vapor to the current amount of water vapor in the room to determine an achievable amount of water vapor.

Figure 6:
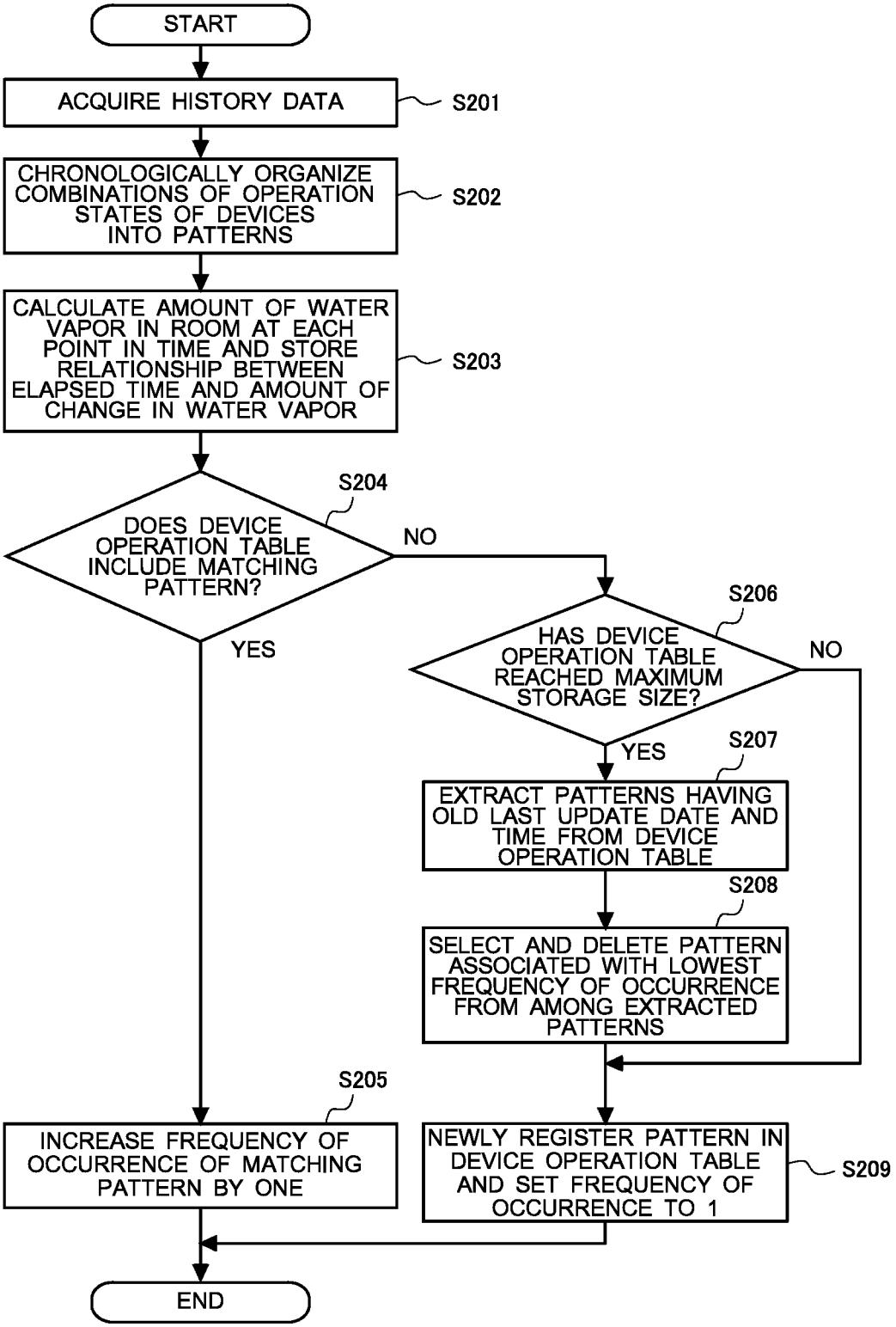
FIG. 6 is a flowchart illustrating an operation of a device operation table compiler in FIG. 2.

FIG. 6 is a flowchart illustrating an operation of the device operation table compiler 131 in FIG. 2. With reference to FIG. 6, a process for creating and updating the device operation table 123 by the device operation table compiler 131 will be described. Note that the series of processes indicated in S201 to S209 in FIG. 6 corresponds to the process of S113 in FIG. 5.

First, the device operation table compiler 131 acquires the history data 122, which is obtained over a period from the point in time of the current data 121 back to the past by a predetermined time period set in advance, from the memory 12 (FIG. 6, step S201). Then, the device operation table compiler 131 acquires information on combinations of the operation states of the devices 30 from the device operation data history 122*b* in the acquired history data 122 and stores the information in the device operation table 123 as time-series data. That is, the device operation table compiler 131 chronologically organizes combinations of the operation states of the devices 30 into patterns (FIG. 6, step S202).

Then, the device operation table compiler 131 calculates the amount of water vapor in the room at each point in time from the air-conditioning apparatus operation data history 122*a* and the sensor data history 122*c*. Each point in time corresponds to a point in time at the end of one of the elapsed times illustrated in FIG. 3. The device operation table compiler 131 computes, on the basis of the calculated amount of water vapor at each point in time, a relationship between the elapsed time and the amount of change in water vapor and stores the computation result in the device operation table 123. More specifically, the device operation table compiler 131 subtracts an amount of occupant-generated water vapor, which is determined by multiplying the number of occupants at each point in time by the unit amount of generated water vapor, from an amount of water vapor at each point in time, which is obtained from an observed value, to determine an amount of change in water vapor, and stores the amount of change in water vapor in the device operation table 123. That is, the device operation table compiler 131 chronologically organizes amounts of change in water vapor and the information on the combinations of the operation states of the devices 30 stored in step S202 in association with each other to form patterns (FIG. 6, step S203).

Subsequently, in step S202, the device operation table compiler 131 determines whether the device operation table 123 has patterns indicating the combinations of the operation states of the devices 30 stored in the device operation table 123. That is, the device operation table compiler 131 determines whether the device operation table 123 has a pattern that matches the combination of the operation states of the devices 30 at the present time (FIG. 6, step S204). When the combination of the operation states of the devices 30 is included (FIG. 6, YES in step S204), the device operation table compiler 131 performs a learning process and increases by one the frequency of occurrence of the pattern that matches the combination of the operation states of the devices 30 at the present time (FIG. 6, step S205).

When there is no combination of the devices 30 in operation (FIG. 6, NO in step S204), the device operation table compiler 131 determines whether the device operation table 123 has reached a maximum storage size (FIG. 6, step S206).

When the device operation table 123 has reached the maximum storage size (FIG. 6, YES in step S206), the device operation table compiler 131 extracts patterns having old last update date and time from the device operation table 123 (FIG. 6, step S207). Then, the device operation table compiler 131 selects and deletes a pattern associated with the lowest frequency of occurrence from among the extracted patterns (FIG. 6, step S208). Then, the device operation table compiler 131 newly registers the pattern created in step S202 in the device operation table 123 and sets its frequency of occurrence to 1 (FIG. 6, step S209). When the device operation table 123 has not reached the maximum storage size (FIG. 6, NO in step S206), the device operation table compiler 131 executes the process of step S209.

Here, the device operation table compiler 131 may store the amounts of water vapor at the points in time, which are calculated in step S203, in the device operation table 123 through learning computation. That is, in the device operation table 123, the operation times of the devices 30 may further be associated with the amounts of water vapor in the room. This configuration enables the condensation occurrence determiner 132 to predict an amount of water vapor that is generated in future from the device 30 currently in operation from a relationship between the device operation data 121*b* in the past and the amount of water vapor in the room at that time.

As described above, in the air-conditioning control device 1 in Embodiment 1, the condensation occurrence determiner 132 uses an amount of change in water vapor, which is predicted by collating the device operation data 121*b* with the device operation table 123, to determine whether condensation occurs in the room after a certain amount of time elapses. Then, the air-conditioning controller 133 controls the operation of the air-conditioning apparatus 2 on the basis of the determination result of the condensation occurrence determiner 132. Thus, the air-conditioning control device 1 can control the operation state of the air-conditioning apparatus depending on a change in the amount of water vapor in a room. Thus, even when the amount of water vapor in the room is changed, the occurrence of condensation can be prohibited.

Further, the device operation table compiler 131 performs a learning process on an amount of change in water vapor or other information stored in a device operation table by using the device operation data history 122*b* including information on the operation states of the devices 30 and the sensor data history 122*c* including information concerning the water vapor in the room. That is, the air-conditioning control device 1 can update the information in the device operation table 123 by using the most recent device operation data history 122*b* including the current device operation data 121*b* and the most recent sensor data history 122*c* including the current sensor data 121*c* at a detection timing corresponding to a predetermined detection interval. Thus, the air-conditioning control device 1 can determine whether condensation occurs in the room by using the most recent amount of change in water vapor on which a learning process has been performed and other information, and therefore determination accuracy can be enhanced.

Furthermore, the air-conditioning control device 1 classifies the frequencies with which the devices 30 are used, combinations of the devices 30, and the durations of operation of the devices 30 into patterns on the basis of the history data 122 and stores the patterns in the memory 12 as the device operation table 123. When the devices 30 are started to be used in future, the device operation table 123 is referred to, thereby predicting the amount of change in water vapor on the basis of the devices 30 that are used simultaneously and on the basis of the duration period of use.

More specifically, when the device unit 3 includes a plurality of devices 30 that change the amount of water vapor, the memory 12 stores the device operation data 121*b* and the device operation data history 122*b* for each of the devices 30. Then, the device operation table compiler 131 classifies combinations of the operation states of the devices 30 in the device operation data history 122*b* into patterns and stores information on the number of occurrences of each of the classified patterns in the device operation table 123 as the frequency of occurrence. When the frequency of occurrence associated with the pattern of the device operation data 121*b* exceeds a threshold, the condensation occurrence determiner 132 acquires the amount of change in water vapor from the device operation table 123. Thus, when a combination of the devices 30 with high frequency is operated, the air-conditioning control device 1 can predict future changes in the operation states of the devices 30 and can predict an amount of change in water vapor caused by the devices 30.

Even when the device unit 3 includes one device 30, operation states of the device 30 may be organized into patterns when the operation states of the device 30 are controllable. That is, the device operation table compiler 131 may classify changes in the operating state of one device 30 into patterns and store information on the number of occurrences of each of the classified patterns in the device operation table 123 as the frequency of occurrence. Thus, when the device 30 is operating in an operation state set with high frequency, the air-conditioning control device 1 can predict future changes in the operation state of the device 30 and can predict an amount of change in water vapor caused by the device 30.

Furthermore, when the condensation occurrence determiner 132 determines that condensation occurs, the air-conditioning controller 133 changes at least one of the airflow direction, the amount of airflow, and the set temperature of the air-conditioning apparatus 2 to fall within a range so that comfortable conditions are maintained inside the room. This configuration enables the air-conditioning control device 1 to prevent condensation before it occurs without impairing comfort in the room.

In addition, the air-conditioning control device 1 includes the number-of-room-occupant specifier 11*d* that species the number of occupants in the room. Thus, when determining whether condensation occurs in the room after a certain amount of time elapses, the condensation occurrence determiner 132 can determine and use an amount of occupant-generated water vapor.

Consequently, the air-conditioning control device 1 can determine the probability of future occurrence of condensation by taking into account the amount of water vapor generated from the body of people present in the room.

Furthermore, in the air-conditioning control device 1, the display device 15 displays information on the current control state of the air-conditioning controller 133. This operation enables the user who views the display device 15 to recognize that the air-conditioning apparatus 2 is operating under anti-condensation control in which an air-conditioning setting is automatically changed. Thus, the air-conditioning control device 1 can improve the degree of satisfaction of the user and can prevent the user who is not aware of a change in the setting from further changing the setting.

It is known that condensation is likely to occur in a wall surface portion such as a thermal bridge portion and a corner portion and a window surface with low heat insulating properties, and the temperature of the wall surface portion is different from the room temperature. However, the air-conditioning apparatus disclosed in Patent Literature 1 uses the room temperature to determine the occurrence of condensation and a temperature distribution along the wall surface portion where condensation actually occurs is not taken into account.

In this respect, the air-conditioning system 100 includes, as the sensor 40 or other similar component, a wall temperature sensor that measures a wall surface temperature, which is a surface temperature of a wall surface portion in the room, and the condensation occurrence determiner 132 determines whether condensation occurs in the room on the basis of information on the wall surface temperature measured by the wall temperature sensor. That is, the condensation occurrence determiner 132 determines a dew-point temperature in the room by using the amount of change in water vapor predicted from the device operation table 123 and information on the wall surface temperature measured by the wall temperature sensor. When a predicted temperature of the wall surface temperature after a certain amount of time elapses falls below the dew-point temperature, the condensation occurrence determiner 132 determines that condensation occurs in the room. When the wall temperature sensor is an infrared camera or other similar device that detects wall surface temperature distribution information indicating a temperature distribution along the surface of the wall surface portion, the condensation occurrence determiner 132 determines, on the basis of the wall surface temperature distribution information, whether condensation occurs for each portion on the wall surface portion. Thus, the air-conditioning control device 1 can identify a portion likely to be subjected to condensation, such as the window 6 and the corner portions 7, by taking into account a distribution of wall surface temperatures without inputting positional information and other information in advance. This configuration saves the user's time and enables more accurate identification of a location with high probability of occurrence of condensation.

In addition, the air-conditioning controller 133 changes the settings of the air-conditioning apparatus 2 for a portion on the wall surface portion where the condensation occurrence determiner 132 determines that condensation occurs. For example, the air-conditioning controller 133 performs control to change, for example, the airflow direction of the air-conditioning apparatus 2 to blow air toward the portion on the wall surface portion where condensation is determined to occur. That is, the air-conditioning control device 1 performs air-conditioning control to change at least one of the airflow direction and the amount of airflow for a portion likely to be subjected to condensation, such as a window surface, a thermal bridge portion, and a corner portion of the wall. Thus, the occurrence of condensation can be prohibited more accurately, and condensation can be prevented before its occurs.

That is, the air-conditioning control device 1 in Embodiment 1 accumulates pieces of the histories of operations usually performed by a user on the devices 30 and learns high-frequency operations of the user. Thus, when the device 30 that can change the amount of water vapor, such as a cooking device, a ventilation device, a dehumidifier, and a humidifier, is operated or when the number of occupants in the room changes, the air-conditioning control device 1 can accurately determine whether condensation occurs. Further, the air-conditioning control device 1 automatically changes the operation state of the air-conditioning apparatus 2 on the basis of the determination result. Thus, the air-conditioning control device 1 can prevent condensation before it occurs and avoid conditions such as defilement and insanitation caused by mold growth on the interior of a room due to condensation water.

Embodiment 2

Figure 7:
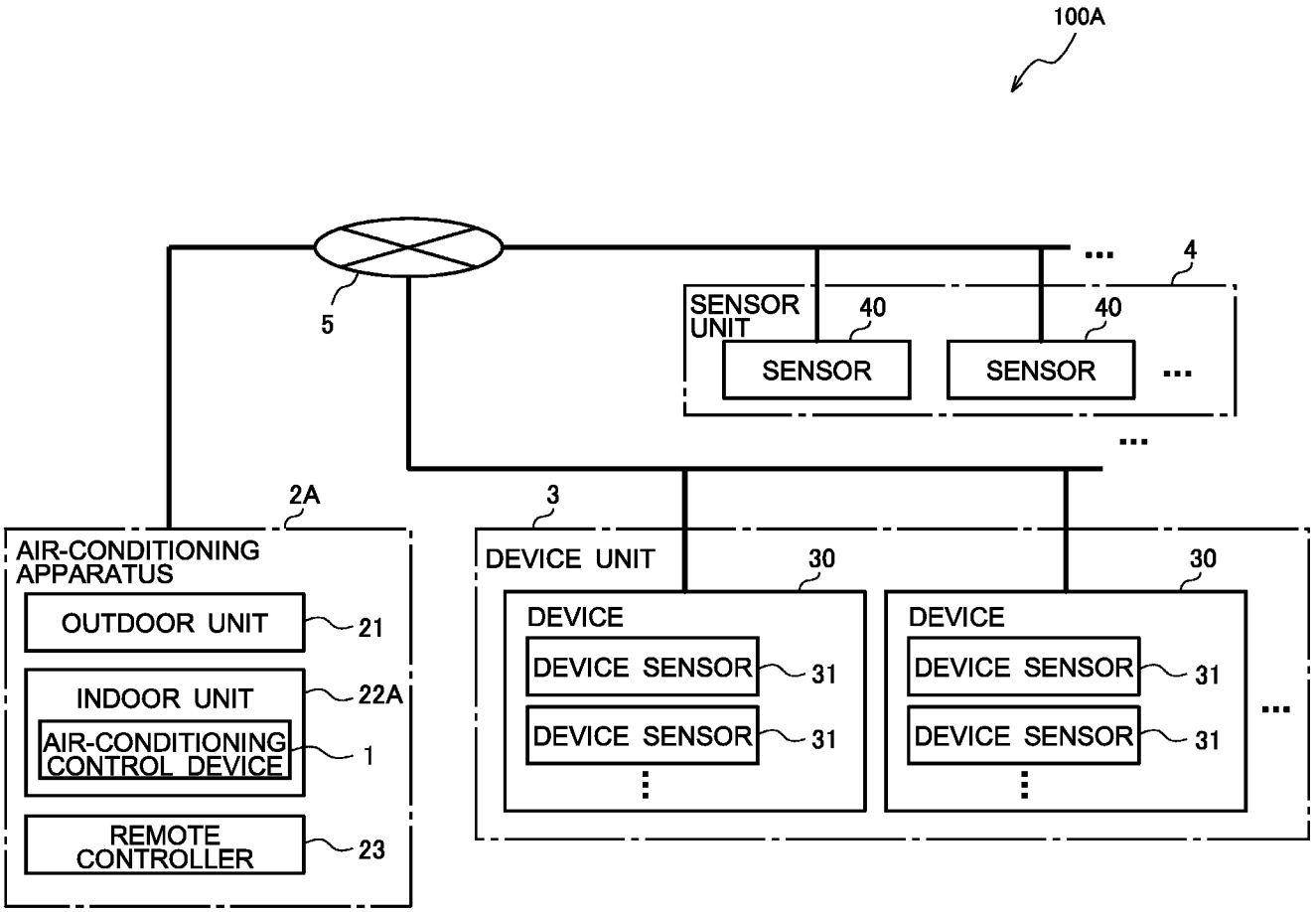
FIG. 7 is a block diagram illustrating a configuration of an air-conditioning system including an air-conditioning control device according to Embodiment 2 of the present invention.

FIG. 7 is a block diagram illustrating a configuration of an air-conditioning system including an air-conditioning control device according to Embodiment 2 of the present invention. The air-conditioning system 100 in Embodiment 1, described above, includes the air-conditioning control device 1 as an element separate from the air-conditioning apparatus 2. In an air-conditioning system 100A in Embodiment 2, in contrast, the air-conditioning control device 1 is included in the air-conditioning apparatus 2. Here, the same elements as those in Embodiment 1 are assigned with the same reference signs and will not be described herein.

As illustrated in FIG. 7, in the air-conditioning system 100A, the air-conditioning control device 1 is mounted in an indoor unit 22A of an air-conditioning apparatus 2A. The air-conditioning apparatus 2A is configured in a manner similar to that in the air-conditioning apparatus 2 of Embodiment 1, except that the air-conditioning apparatus 2A includes the air-conditioning control device 1. That is, the air-conditioning system 100A operates in a manner similar to that in the air-conditioning system 100 of Embodiment 1, and the operation of the air-conditioning system 100A will not be thus described herein.

The air-conditioning control device 1 may be configured integrally with a controller (not illustrated) that controls the indoor unit 22A or with a controller (not illustrated) that controls the outdoor unit 21 and the indoor unit 22A. It should be noted that the air-conditioning apparatus 2A may be an integrated air-conditioning apparatus having both the function of the outdoor unit 21 and the function of the indoor unit 22A, in which case, the air-conditioning control device 1 is mounted in the main body of the air-conditioning apparatus 2A.

As described above, in the air-conditioning apparatus 2A in Embodiment 2, the air-conditioning control device 1 determines the probability of occurrence of condensation after a certain amount of time elapses on the basis of a predicted amount of change in water vapor, and controls the operation of the air-conditioning apparatus 2A on the basis of the determination result. Thus, the air-conditioning apparatus 2A can control the operation state of the air-conditioning apparatus depending on a change in the amount of water vapor in a room. Thus, even when the amount of water vapor in the room is changed, the occurrence of condensation can be prohibited.

That is, the air-conditioning apparatus 2A includes the air-conditioning control device 1 and is controlled by the air-conditioning control device 1. That is, in the air-conditioning apparatus 2A, the internal control device can predict the amount of water vapor that will be generated in the room from a change in the operation state of the device 30 and can automatically change the operation state of the air-conditioning apparatus 2A. Thus, costs can be reduced, and condensation can be prevented before it occurs. Other advantageous effects are similar to those of Embodiment 1.

Embodiment 3

Figure 8:
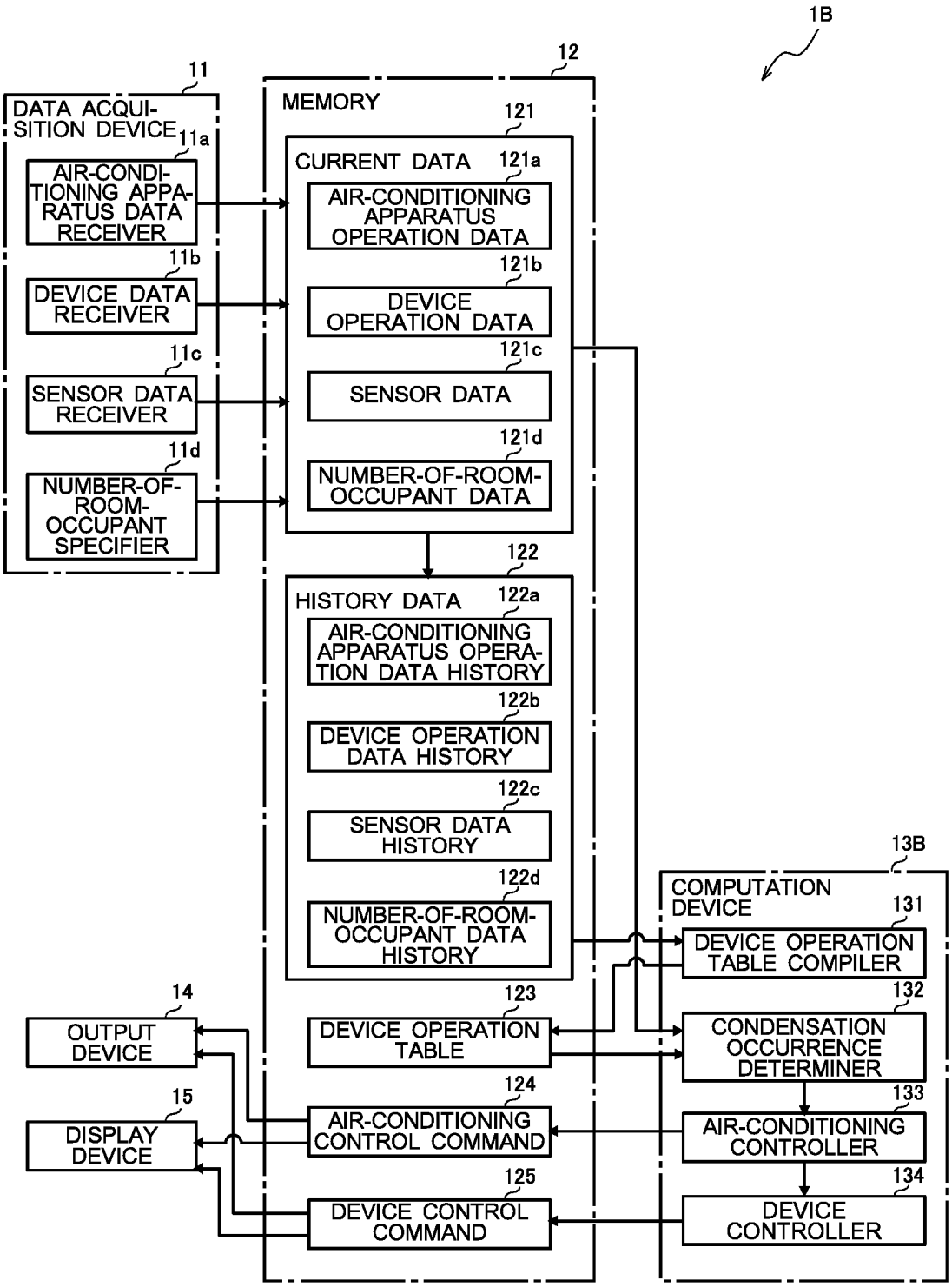
FIG. 8 is a block diagram illustrating a functional configuration of an air-conditioning control device included in an air-conditioning system according to Embodiment 3 of the present invention.

FIG. 8 is a block diagram illustrating a functional configuration of an air-conditioning control device included in an air-conditioning system according to Embodiment 3 of the present invention. The air-conditioning system in Embodiment 3 is configured in a manner similar to that of the air-conditioning system 100 illustrated in FIG. 1 or the air-conditioning system 100A illustrated in FIG. 7, and includes an air-conditioning control device 1B illustrated in FIG. 8 instead of the air-conditioning control device 1. Elements equivalent to those in Embodiments 1 and 2 described above are assigned with the same reference signs and will not be described herein.

As illustrated in FIG. 8, the air-conditioning control device 1B includes a computation device 13B including a device controller 134 that controls the operation of the device 30. The other elements of the computation device 13B are similar to those of the computation device 13 of Embodiment 1. The device controller 134 changes the operation state of the device 30 when the condensation occurrence determiner 132 determines that condensation occurs after the air-conditioning controller 133 changes the operation state of the air-conditioning apparatus 2. In the following, the control of the air-conditioning apparatus 2 and the device 30 that is performed by the air-conditioning control device 1B to prevent condensation in the room before it occurs is referred to as anti-condensation control.

That is, the air-conditioning control device 1B can perform anti-condensation control by using the control of the air-conditioning apparatus 2 and the control of the device 30 in combination. For example, the air-conditioning control device 1B can perform control such a manner that, when the occurrence of condensation is inevitable after the air-conditioning controller 133 controls the air-conditioning apparatus 2 not to impair comfort in the room, the device controller 134 changes the operation state of the device 30. That is, the air-conditioning control device 1B also controls the operation state of the device 30 that affects the amount of water vapor in the room under conditions in which condensation can occur and in which the occurrence of condensation is not avoidable only with the control of the air-conditioning apparatus 2, thereby being able to prevent condensation before it occurs.

When the device unit 3 includes a plurality of devices 30, the device controller 134 may be configured to be able to control all of the devices 30 or control at least one of the plurality of devices 30. That is, the device controller 134 changes the operation state of a device 30 that is a control target with reference to controllability that is set in advance for each of the devices 30. For example, the device controller 134 stops the operation of the device 30 that is a control target, or reduces the operation state of the device 30 that is a control target so that the temperature in the room becomes greater than or equal to the dew-point temperature after a certain amount of time elapses.

More specifically, the device controller 134 determines the content of control to be performed on the device 30, such as stopping the operation of the device 30, when the condensation occurrence determiner 132 determines that condensation occurs even after the air-conditioning controller 133 changes the operation state of the air-conditioning apparatus 2 depending on determined content and performs air-conditioning control to prevent the occurrence of condensation. Then, the device controller 134 issues a device control command 125 indicating the determined content of control and stores the issued device control command 125 in the memory 12. That is, the memory 12 in Embodiment 3 is configured to store the device control command 125. The device controller 134 may issue the device control command 125 when, for example, a control command from the air-conditioning controller 133 is received.

Further, the output device 14 in Embodiment 3 has a function of reading the device control command 125 from the memory 12 and transmitting a control command to the device 30 that is a control target, in accordance with the device control command 125. That is, the device controller 134 controls the device 30 through the output device 14.

Further, the display device 15 in Embodiment 3 has a function of displaying the control performed on the device 30 by the device controller 134. That is, the display device 15 displays information on the control state of the device 30 based on the device control command 125 stored in the memory 12. Other functional elements and operations are similar to those in Embodiment 1, described above, and will not be described herein.

As described above, the air-conditioning control device 1B determines whether condensation occurs after a certain amount of time elapses by using an amount of change in water vapor, which is predicted from the device operation data 121*b* and the device operation table 123, and controls the operation of the air-conditioning apparatus 2 on the basis of the determination result. Thus, as the air-conditioning control device 1B can control the operation state of the air-conditioning apparatus depending on a change in the amount of water vapor in the room, the occurrence of condensation can be prohibited even when the amount of water vapor in the room is changed.

Furthermore, the air-conditioning control device 1B in Embodiment 3 can control the device 30. Thus, when the occurrence of condensation is inevitable only with the control of the air-conditioning apparatus 2, the device 30 that changes the amount of water vapor is controlled, thereby enabling condensation to be prevented before it occurs. The air-conditioning control device 1B can more accurately prohibit the occurrence of condensation when the device 30 that is a control target of the device controller 134 is a humidifier or other similar device generating water vapor. Other advantageous effects are similar to those of Embodiments 1 and 2.

The embodiments described above are preferable specific examples of an air-conditioning control device, an air-conditioning apparatus, and an air-conditioning system, and the technical scope of the present invention is not limited to these aspects. For example, in FIG. 4, a building in which the air-conditioning control device 1 performs anti-condensation control is a normal house, and the air-conditioning apparatus 2 is a room air conditioner that is a typical air-conditioning apparatus installed in a house, by way of example, but not limitation. For example, a building in which the air-conditioning control devices 1 and 1B perform anti-condensation control may be a large building or other structure, and the air-conditioning apparatus 2 may be an air handling unit or other similar device installed in a large building or other structure. In addition, the air-conditioning control devices 1 or 1B may include an input device that accepts an input operation performed by a user or any other person. The user or any other person may set and change a threshold, a detection interval, an elapsed time, or other aspect through the input device.

REFERENCE SIGNS LIST

1 air-conditioning control device 1B air-conditioning control device 2 air-conditioning apparatus 2A air-conditioning apparatus 3 device unit 4 sensor unit 5 control network 6 window 7 corner portion 11 data acquisition device 11*a* air-conditioning apparatus data receiver 11*b* device data receiver 11*c* sensor data receiver 11*d* number-of-room-occupant specifier 12 memory 13, 13B computation device 14 output device 15 display device outdoor unit 22, 22A indoor unit 23 remote controller 30 device 30*a* IH cooker 30*b* ventilation fan 30*c* humidifier 31 device sensor 40 sensor 100, 100A air-conditioning system 121 current data 121*a* air-conditioning apparatus operation data 121*b* device operation data 121*c* sensor data 121*d* number-of-room-occupant data 122 history data 122*a* air-conditioning apparatus operation data history 122*b* device operation data history 122*c* sensor data history 122*d* number-of-room-occupant data history 123 device operation table 124 air-conditioning control command 125 device control command 131 device operation table compiler 132 condensation occurrence determiner 133 air-conditioning controller 134 device controller 200 room

The invention claimed is:

1. An air-conditioning control device for controlling an air-conditioning apparatus configured to perform air conditioning of a room in which a water vapor changer that changes an amount of water vapor is located, the air-conditioning control device comprising:

a processor; and a memory configured to store a device operation table having an operation time of the water vapor changer and an amount of change in water vapor in the room in association with each other, and device operation data concerning an operation state of the water vapor changer, wherein the memory is configured to store sensor data including information on the amount of water vapor in the room, a sensor data history that is a history of the sensor data in past times, and a device operation data history that is a history of the device operation data in past times, wherein the processor configured to create the device operation table, perform a learning process on the amount of change in water vapor stored in the device operation table by using the device operation data history and the sensor data history, classify combinations of operation states of the plurality of the water vapor changers into patterns from the device operation data history and store information on a number of occurrences of each of the classified patterns in the device operation table as a frequency of occurrence, predict the amount of change in water vapor until after a lapse of a predetermined amount of time by collating the device operation data with the device operation table when the frequency of occurrence associated with a pattern in the device operation data exceeds a threshold, determine whether condensation occurs in the room after the predetermined amount of time elapses by using the predicted amount of change in water vapor, and change an operation state of the air-conditioning apparatus when the processor determines that condensation occurs.

2. The air-conditioning control device of claim 1, wherein the device operation table has the operation time of the water vapor changer and the amount of water vapor in the room in association with each other.

3. The air-conditioning control device of claim 1, wherein the processor is configured to change at least one of an airflow direction, an amount of airflow, and a set temperature of the air-conditioning apparatus when the processor determines that condensation occurs.

4. The air-conditioning control device of claim 1, wherein the memory is configured to store information on an amount of generated water vapor per occupant, and wherein the processor is configured to:

specify a number of occupants in the room, and determine whether condensation occurs by further using an amount of occupant-generated water vapor determined by multiplying the amount of generated water vapor per occupant by the number of occupants which have been specified.

5. The air-conditioning control device of claim 1, further comprising a display device configured to display information on a current control state of the processor.

6. An air-conditioning apparatus comprising the air-conditioning control device of claim 1, wherein the air-conditioning apparatus is controlled by the air-conditioning control device.

7. An air-conditioning system comprising:

an air-conditioning control device for controlling an air-conditioning apparatus configured to perform air conditioning of a room in which a water vapor changer that changes an amount of water vapor is located, the air-conditioning control device comprising:

a processor; and a memory configured to store a device operation table having an operation time of the water vapor changer and an amount of change in water vapor in the room in association with each other, and device operation data concerning an operation state of the water vapor changer, wherein the memory is configured to store sensor data including information on the amount of water vapor in the room, a sensor data history that is a history of the sensor data in past times, and a device operation data history that is a history of the device operation data in past times, wherein the processor configured to create the device operation table, perform a learning process on the amount of change in water vapor stored in the device operation table by using the device operation data history and the sensor data history, classify combinations of operation states of the plurality of the water vapor changers into patterns from the device operation data history and store information on a number of occurrences of each of the classified patterns in the device operation table as a frequency of occurrence, predict the amount of change in water vapor until after a lapse of a predetermined amount of time by collating the device operation data with the device operation table when the frequency of occurrence associated with a pattern in the device operation data exceeds a threshold, determine whether condensation occurs in the room after the predetermined amount of time elapses by using the predicted amount of change in water vapor, and change an operation state of the air-conditioning apparatus when the processor determines that condensation occurs, an air-conditioning apparatus controlled by the air-conditioning control device; and a wall temperature sensor configured to measure a wall surface temperature that is a surface temperature of a wall surface portion which comprises multiple portions in the room, wherein the processor is configured to determine a dew-point temperature in the room by using the amount of change in water vapor predicted from the device operation table and by using information on the wall surface temperature measured by the wall temperature sensor, and determine that condensation occurs in the room when a predicted temperature of the wall surface temperature after the predetermined amount of time elapses falls below the dew-point temperature.

8. The air-conditioning system of claim 7, wherein the wall temperature sensor comprises an infrared camera, and wherein the processor is configured to acquire wall surface temperature distribution information indicating a temperature distribution along a surface of the wall surface portion from the infrared camera as the information on the wall surface temperature, and determine, on a basis of the acquired wall surface temperature distribution information, whether condensation occurs for each portion of the wall surface portion.

9. The air-conditioning system of claim 8, wherein the processor is configured to change a setting of the air-conditioning apparatus for a portion of the wall surface portion where the processor determines that condensation occurs.

10. The air-conditioning system of claim 7, wherein the air-conditioning apparatus includes the air-conditioning control device.

11. An air-conditioning control device for controlling an air-conditioning apparatus configured to perform air conditioning of a room in which a water vapor changer that changes an amount of water vapor is located, the air-conditioning control device comprising:

a memory configured to store device operation data concerning an operation state of the water vapor changer and a device operation table having an operation time of the water vapor changer and an amount of change in water vapor in the room in association with each other; and a processor configured to predict the amount of change in water vapor until after a lapse of a predetermined amount of time by collating the device operation data with the device operation table, determine whether condensation occurs in the room after the predetermined amount of time elapses by using the predicted amount of change in water vapor, change an operation state of the air-conditioning apparatus when the condensation occurrence determination circuitry determiner determines that condensation occurs, and change the operation state of the water vapor changer when the condensation occurrence determination circuitry determines that condensation occurs after the air-conditioning controller changes the operation state of the air-conditioning apparatus.

* * * * *